US006848658B2

(12) United States Patent
McAllister

(10) Patent No.: US 6,848,658 B2
(45) Date of Patent: Feb. 1, 2005

(54) TRAIN DETECTION

(75) Inventor: Lawrence Lawson McAllister, Chippenham (GB)

(73) Assignee: Westinghouse Brake and Signal Holdings Limited, Chippenham (GB)

( * ) Notice: Subject to any disclaimer, the term of this patent is extended or adjusted under 35 U.S.C. 154(b) by 0 days.

(21) Appl. No.: 10/228,359

(22) Filed: Aug. 26, 2002

(65) Prior Publication Data

US 2003/0058119 A1 Mar. 27, 2003

(30) Foreign Application Priority Data

Sep. 25, 2001 (GB) ..... 0123058

(51) Int. Cl.[7] ..... B61L 25/00
(52) U.S. Cl. ..... 246/122 R
(58) Field of Search ..... 246/5, 122 R, 246/182 B; 701/19, 207; 340/988

(56) References Cited

U.S. PATENT DOCUMENTS

| | | | | | |
|---|---|---|---|---|---|
| 5,012,424 | A | * | 4/1991 | Dodson | 701/207 |
| 5,018,689 | A | * | 5/1991 | Yasunobu et al. | 246/182 B |
| 5,129,605 | A | * | 7/1992 | Burns et al. | 246/5 |
| 5,364,047 | A | * | 11/1994 | Petit et al. | 246/122 R |
| 5,740,547 | A | * | 4/1998 | Kull et al. | 701/19 |
| 5,893,043 | A | * | 4/1999 | Moehlenbrink et al. | 701/207 |
| 6,195,023 | B1 | * | 2/2001 | Walsh et al. | 340/988 |

FOREIGN PATENT DOCUMENTS

| | | |
|---|---|---|
| DE | 260 470 A1 | 9/1988 |
| EP | 0 825 418 A2 | 2/1998 |

* cited by examiner

*Primary Examiner*—Mark T. Le
(74) *Attorney, Agent, or Firm*—Welsh & Katz, Ltd.

(57) ABSTRACT

A train location arrangement interleaves a plurality of detection systems to provide, in combination, a higher resolution of train detection than would be provided by one of the systems on its own.

8 Claims, 2 Drawing Sheets

TRAIN DETECTION

The present invention relates to train detection.

Train detection is a key part of a railway control system and the availability of accurate information about train location is essential to the safe and smooth running of a railway. Traditionally, either track circuits or axle counter techniques have been used to provide train detection and there are various advantages and disadvantages associated with the selection of either axle counter or track circuit systems. Some of the trade-offs are:

- Track circuits offer continuous detection of trains along the circuit length while axle counters only detect the passage of vehicles at points.
- Track circuits offer the potential for emergency protection by shunting the rails, unlike axle counters.
- Axle counters are significantly more isolated from the rail and thus perform better in the presence of electric traction.
- Track circuits generally complicate electrical traction return bonding.
- Track circuits offer some degree of rail continuity detection, unlike axle counters.
- Axle counters need to be initialized at power up while track circuits can readily determine if the track is clear when initially powered up.
- Short track circuits require physical rail isolating joints which are expensive to install and maintain.
- Track circuits are vulnerable to severe rail contamination which makes reliable train detection in all seasons difficult.

A system that utilizes both axle counters and track circuits could draw from the best features of both. However, to just lay the two systems on top of each other is unjustifiably expensive, so such an approach would be immediately rejected.

According to the present invention, there is provided a train location arrangement utilizing a plurality of train detection systems which are interleaved to provide, in combination, a higher resolution of train detection than would be achieved by one of the systems on its own.

Train detection information from the systems could be combined in order to provide for improved availability, so that if one of the systems fails, then train location is still provided by the or each other system.

Train detection information from the two systems could be combined in order to provide for improved safety, so that if one of systems fails to correctly indicate the location of a train, then safe detection is still provided by the or each other system.

Preferably, the train detection systems are different from each other.

One of the train detection systems could be a track circuit system.

One of the train detection systems could be an axle counter system.

If one of the systems is a track circuit system and the other or another of the systems is an axle counter system, the arrangement could be such that if a track circuit section indicates that an axle counter section is clear, this enables a reset of the axle counter section.

If one of the systems is a track circuit system and the other or another of the systems is an axle counter system, the arrangement could be such that if axle counters indicate that a track circuit section is clear, this is utilized to enable auto-adjustment of the track circuit section.

The present invention will now be described, by way of example, with reference to the accompanying drawings, in which.

Figure 1:
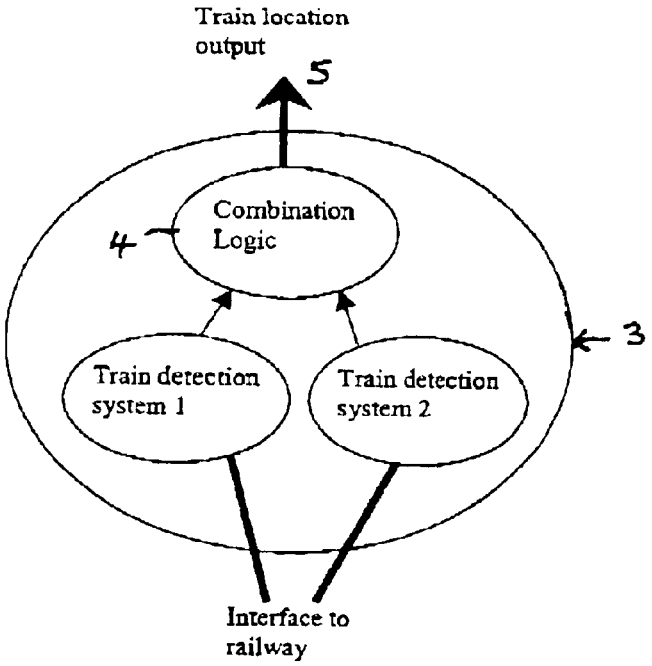
FIG. 1 is a schematic outline of an example of an arrangement according to the present invention.

Referring first to FIG. 1, the outputs from two different (diverse) train detection systems 1 and 2 in a train location arrangement 3 and interfaced to a railway are combined in combination logic 4 to provide a train location output at 5. In the following example, one of the systems is a track circuit system and the other is an axle counter system.

Figure 2:
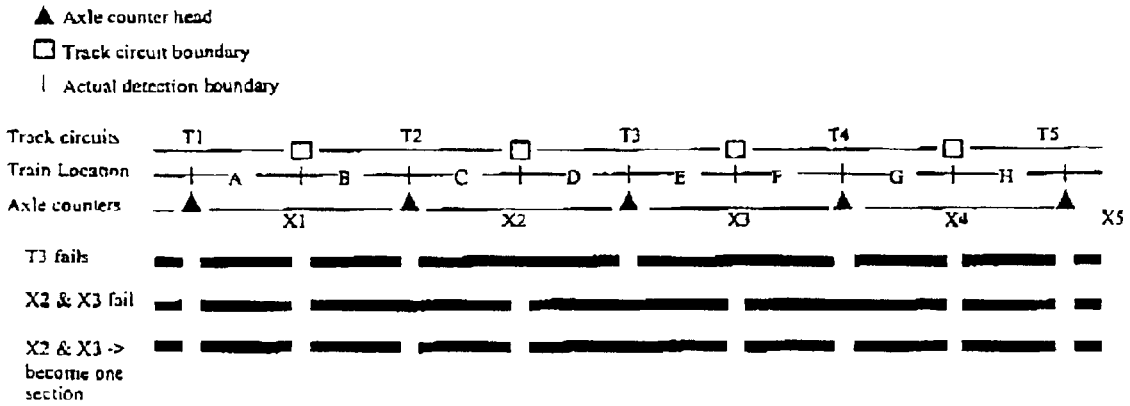
FIG. 2 shows interleaving of track circuit and axle counter sections.

The following example does not just overlay track circuits and axle counters but interleaves them. Interleaving of track circuits and axle counters offers the same resolution of train detection with diverse equipment at little extra cost. FIG. 2 outlines an interleaved arrangement of track circuit sections and axle counter sections. It can be seen that eight distinct train location sections are provided (A–H) by the use of five track circuit sections T1 . . . T5 and four axle counter sections X1 to X4.

Consider a train standing in section D of FIG. 2. Its location in section D is deduced from the occupancy of track circuit section T3 and axle counter section X2.

Figure 3:
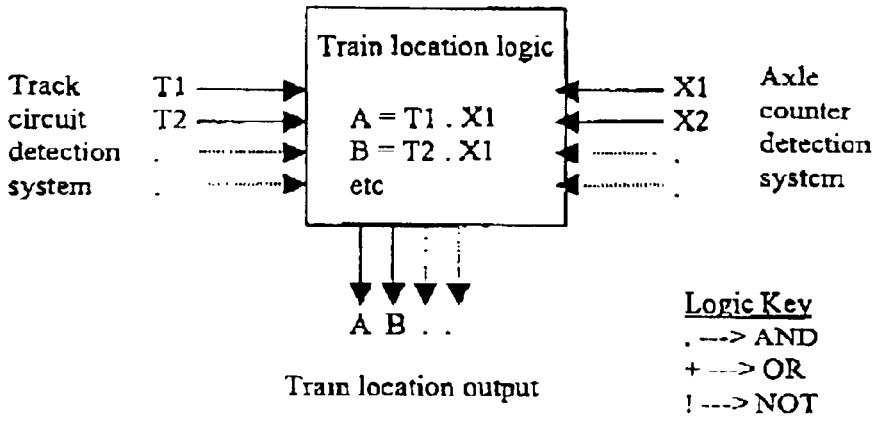
FIG. 3 shows a basic "AND" combination logic which may be used.

FIG. 3 illustrates the use of basic "AND" logic operators to derive the state of the location sections (A–H of FIG. 2). This basic implementation of the invention treats the axle counter and track circuit systems as sufficiently fail-safe in their own right (i.e. they only show clear when there is definitely not a train). It should be appreciated that the logic processing has to be of sufficiently high integrity and, this could be carried out in the signaling interlocking of the railway.

The basic "AND" logic combination illustrated in FIG. 3 gives improved availability of train detection. Consider the situation where track circuit section T3 develops a fault. The fail-safe nature of track circuit section T3 results in the fault leading to track circuit section T3 showing the track permanently occupied and thus it is no longer possible to discern if the train is in location section D or E. However, it is possible to deduce from axle counter sections X2 and X3 when track circuit section T3 is clear. Thus the train service may continue to operate with a reduction in resolution of detection around track circuit section T3 as indicated by the "T3 fails" line in FIG. 2. Similarly, if the axle counter head between axle counter sections X2 and X3 fails this may cause both of these sections to fail to the occupied state ("X2 & X3 fail" in FIG. 2). Alternatively, axle counter sections may be combined to configure out failed axle counter heads, the possible influence of which is illustrated by the line "X2 & X3 become one section" in FIG. 2.

If the combining logic was "OR" instead of "AND" then optimum safety would be achieved as both track circuit and axle counter detection systems would have to show a section clear before the section was considered clear. Thus, the unsafe failure mode of a section being indicated clear when it is occupied is made considerably less likely than with a traditional single train detection system. However, this particular implementation brings little other benefit.

Figure 4:
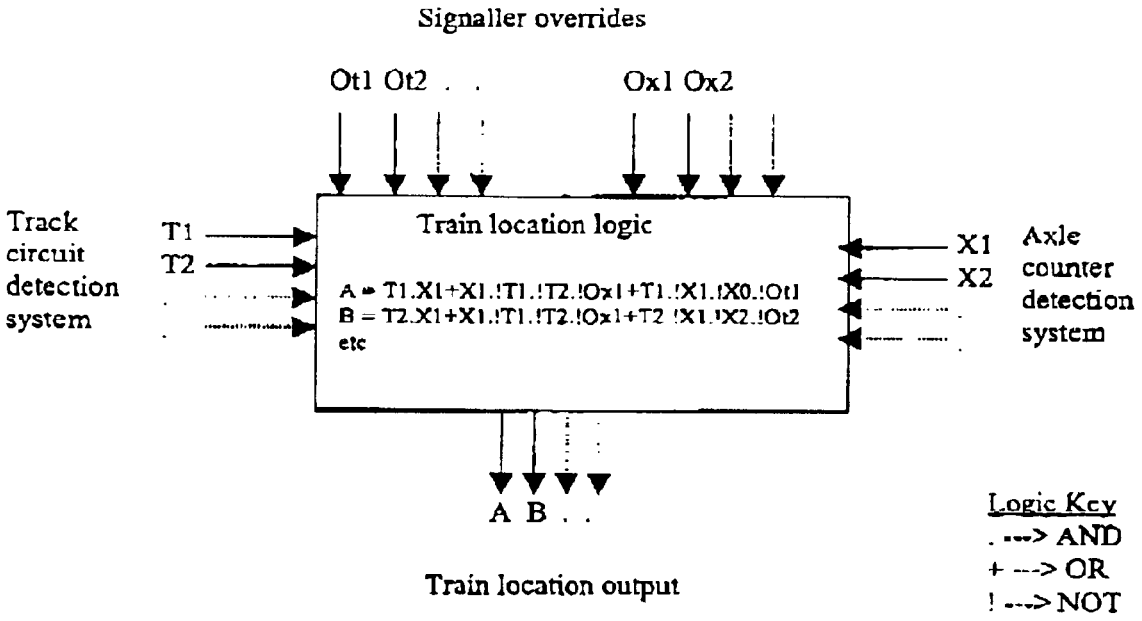
FIG. 4 shows a more advanced combination logic with an override facility.

There are other techniques that may be applied to the combining logic to better manage the redundancy depending upon the specific application details. One approach which achieves a compromise between improving availability and safety is illustrated in FIG. 4. In normal operation, the train position is located, as is the case with the basic "AND" function. However, unlike the basic "AND" function, if a detection section fails to detect a train the train is not lost and this is a safety benefit. The override inputs (Ot1, Ot2 . . . and Ox1, Ox2 . . . of FIG. 4) allow a signaler to temporarily (until repair is effected) override detection section circuits that have failed to the occupied stated, thus realizing improved availability.

One difficulty with axle counters is that, if they lose count due to some transient disturbance (e.g. power loss), they lock in the occupied state until reset. Before resetting an axle counter it is essential to ensure the section being reset is truly clear. This can be achieved by gating the reset of an axle counter section with the occupancy of the associated train detection sections so an axle counter section can not be easily reset if the corresponding track circuit section is occupied. This technique is equally applicable to enabling the auto adjustment of an advanced track circuit. Example logic equations for axle counter X2 and track circuit T2 are:

Reset X2=ResReq X2.!T2.!T3

Reset T2=ResReq T2.!X1.!X2 where:

. ->AND

+->OR

!->NOT

What is claimed is:

1. A train location arrangement comprising at least a first train detection means and a second train detection means;

said first train detection means comprising a plurality of track circuits;

said second train detection means comprising a plurality of axle counters;

each of said plurality of track circuits and each of said plurality of axle counters being in sections, and interleaved such that each track circuit section is offset from each axle counter section;

wherein the location of a train may be determined to within a length of track smaller than the length of either a track circuit section or an axle counter section by combining detection signals from both the first train detection means and the second train detection means.

2. A train location arrangement according to claim 1, wherein train detection information from the two detection means is combined in order to provide for improved availability, so that if one of the systems fails, then train location is still provided by the or each other system.

3. A train location arrangement according to claim 1, wherein train detection information from the two detection means is combined in order to provide for improved safety, so that if one of systems fails to correctly indicate the location of a train, then safe detection is still provided by the or each other system.

4. A train location arrangement according to claim 1, wherein one of the train detection means is a track circuit and another is an axle counter and wherein if the axle counters indicate that a track circuit section is clear, this is utilized to enable auto-adjustment of the track circuit section.

5. A train location arrangement according to claim 1, wherein if an axle counter indicates that a track circuit section is clear, this is utilized to change the indication of the track circuit in the 1st section.

6. A train location arrangement utilizing a plurality of train detection systems which are interleaved to provide, in combination, a higher resolution of train detection than would be achieved by one of the systems on its own comprising at least a first train detection means and a second train detection means; each of said train detection means being in sections and interleaved such that each of the sections of the first train detection means are offset from each of the sections of the second train detection means;

wherein the location of a train maybe determined to be within a length of track smaller than the length of either a first train detection means sections or a second train detection means section by combining detection signals from both the first train detection means and the second train detection means.

7. A train location arrangement comprising at least a first train detection means and a second train detection means;

said first train detection means comprising a plurality of track circuits;

said second train detection means comprising a plurality of axle counters;

each of said plurality of truck circuits and each of said plurality of axle counters being interleaved and in sections, said axle counter in a first section indicating a first condition in the absence of a passing train in the first section and second condition in the presence of a passing train in the first section;

said track circuit indicating the presence or absence of a train in the first section;

said axle counter in the first section changing from said second condition to said first condition on the indication of the absence of a train by said track circuit in the first section.

8. A train location means comprising at least a first train detection means and a second train detection means;

said first train detection means comprising a plurality of track circuits;

said second train detection means comprising a plurality of axle counters;

each of said plurality of track circuits and each of said plurality of axle counters being interleaved and in sections, said track circuits in a first section indicating a first condition in the absence of a passing train in the first section and second condition in the presence of a passing train in the first section;

said axle counter indicating the presence or absence of a train in the first section;

said track circuit in the first section changing from said second condition to said first condition on the indication of the absence of a train by said axle counter in the first section.

* * * * *